United States Patent [19]

Donnelly

[11] 4,406,612

[45] Sep. 27, 1983

[54] OIL BURNER PRIMARY CONTROL FOR INTERRUPTED IGNITION SYSTEM

[75] Inventor: Donald E. Donnelly, Edwardsville, Ill.

[73] Assignee: Emerson Electric Co., St. Louis, Mo.

[21] Appl. No.: 313,739

[22] Filed: Oct. 22, 1981

[51] Int. Cl.[3] ..... F23N 5/00; F23N 5/08

[52] U.S. Cl. ..... 431/71; 431/69; 431/79; 307/117

[58] Field of Search ..... 431/6, 12, 18, 67, 69, 431/71, 74, 79; 307/117; 328/2, 6; 340/664

[56] References Cited

U.S. PATENT DOCUMENTS

| | | | |
|---|---|---|---|
| 3,380,796 | 4/1968 | Kompelien | 431/69 X |
| 3,393,966 | 7/1968 | Clark | 431/69 X |
| 3,713,766 | 1/1973 | Donnelly et al. | 431/69 |
| 4,070,144 | 1/1978 | Wyland et al. | 431/79 |
| 4,242,081 | 12/1980 | Donnelly et al. | 431/71 |
| 4,321,480 | 3/1982 | Miles | 431/79 X |
| 4,370,125 | 1/1983 | Donnelly et al. | 431/79 X |

*Primary Examiner*—Samuel Scott
*Assistant Examiner*—Randall L. Green
*Attorney, Agent, or Firm*—Paul A. Becker, Sr.

[57] ABSTRACT

An oil burner primary control in an interrupted ignition burner control system includes a regulating circuit for regulating the voltage across a flame-responsive photoconductive cell. The regulating circuit ensures that, in the event the cell becomes defective so as to exhibit abnormal resistance characteristics, the system will not permit fuel to flow unless a burner flame exists or unless the igniter and a safety circuit are energized.

1 Claim, 1 Drawing Figure

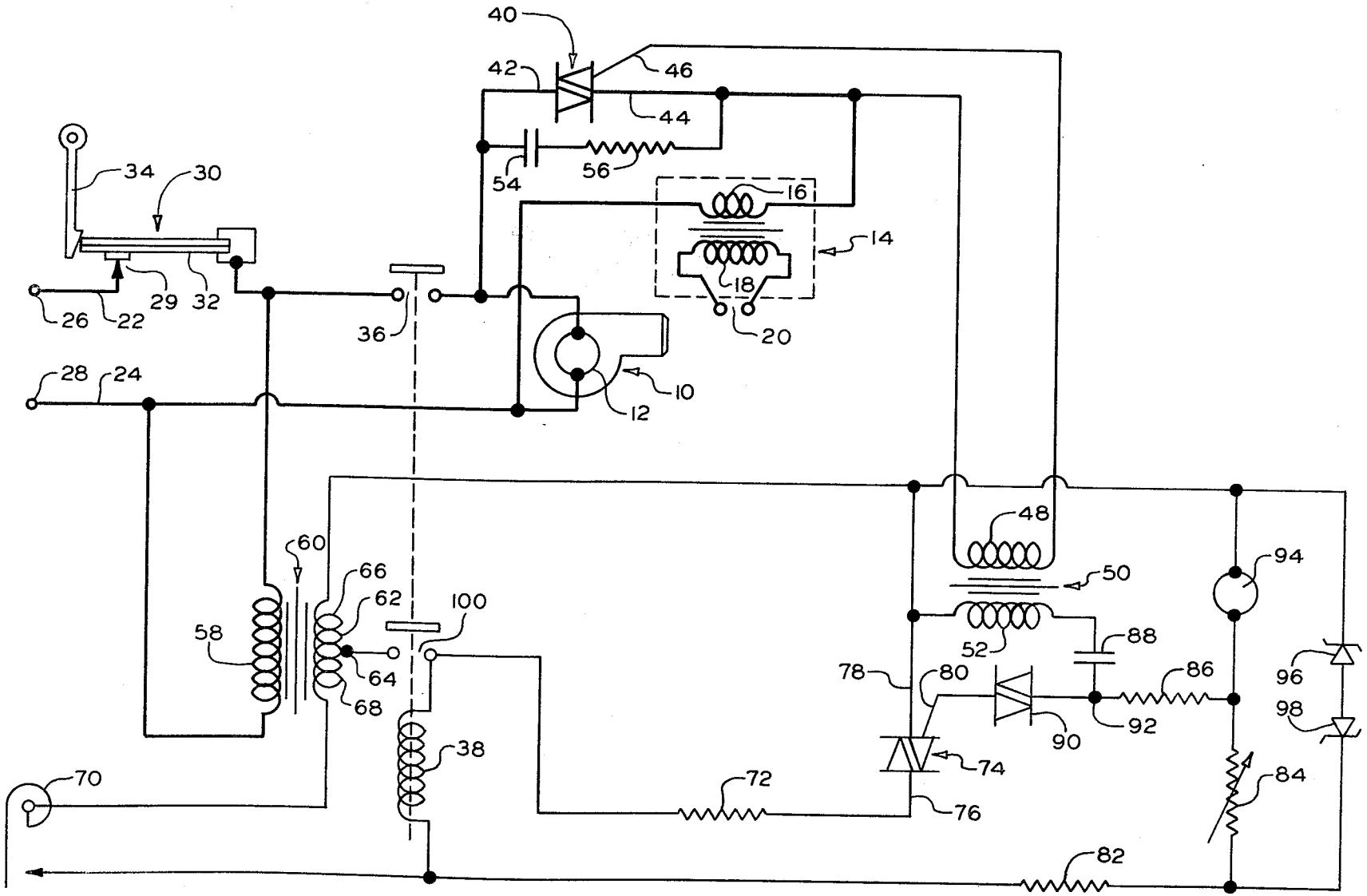
10
12
14
16
18
20
22
24
26
28
29
30
32
34
36
38
40
42
44
46
48
50
52
54
56
58
60
62
64
66
68
70
72
74
76
78
80
82
84
86
88
90
92
94
96
98
100

OIL BURNER PRIMARY CONTROL FOR INTERRUPTED IGNITION SYSTEM

BACKGROUND OF THE INVENTION

This invention relates to oil burner primary controls for interrupted ignition systems utilizing a photoconductive cell to detect the presence and absence of burner flame, and particularly to an improvement therein which ensures safe operation in the event of a particular type of failure of the photoconductive cell.

Disclosed in U.S. Pat. No. 4,242,081, assigned to the assignee of the present invention, is an oil burner primary control for an interrupted ignition system which utilizes a photoconductive cell. As described therein, the cell is part of a gating circuit for a triac. On a call for heat, the resistance of the cell, in the absence of burner flame, is extremely high and gates the triac on. With the triac on, a relay winding is energized by the secondary winding of a voltage step-down transformer. One set of contacts of the relay is effective to energize the fuel supply means, and another set of contacts of the relay establishes a hold-in circuit for the relay winding and connects the safety heater and triac across a portion of the transformer secondary winding. Also occurring when the triac is gated on, is the generation of pulses in a coupling transformer which enables energizing of the igniter.

In the system described in U.S. Pat. No. 4,242,081, under normal operation, combustion occurs before the safety heater has heated sufficiently to open its contacts, which opening would place the system in a lock-out condition. When burner flame appears, the resistance of the photoconductive cell drops very quickly to a value insufficient to effect continued gating of the triac. With the triac off, the safety heater and the igniter are de-energized, and the fuel supply means remains energized. These conditions persist until the thermostat opens to de-energize the relay winding.

There is one particular abnormal condition, however, in which operation of the referenced system is unacceptable. Specifically, it has recently been observed that a prolonged exposure of the cell to a temperature above its temperature rating may cause a drastic change in its resistance characteristics. More specifically, such prolonged exposure may cause the cell resistance to tend to linger at the resistance value it possesed at the high temperature, and to change its resistance value very slowly instead of essentially instantaneously.

With such a defective cell, the burner-on cycle during which the cell becomes defective will terminate normally when the thermostat opens. If the cell resistance remains at a very low value after the flame goes out and is still low on the next call for heat, the voltage across the cell will not be sufficient to effect gating of the triac. If the cell resistance increases sufficiently, the voltage across the cell becomes sufficient to effect gating of the triac. With the triac on, the relay winding is energized. Energizing of the relay winding causes a drop in the voltage at the transformer secondary winding which causes a corresponding drop in voltage across the cell. If the resistance of the cell is increasing very slowly, this voltage drop will result in the voltage across the cell being again insufficient to effect gating of the triac so that the triac is no longer on. Until the cell resistance increases to the value sufficient to again effect gating of the triac, fuel is flowing and the igniter and safety heater are de-energized. This condition is unacceptable since it can result in an accumulation of large amounts of unburned fuel in the combustion chamber.

SUMMARY OF THE INVENTION

It is, therefore, a primary object of this invention to provide an improved oil burner primary control for interrupted ignition systems utilizing a photoconductive cell wherein means are provided to ensure safe operation in the event that the cell resistance characteristics change drastically.

A further object is to provide an improved oil burner primary control for interrupted ignition systems utilizing a photoconductive cell wherein voltage regulating means are connected in circuit with the cell to render the cell independent of variations in the voltage source connected to the cell, so that, once the voltage across the cell is sufficient to initiate a new burner cycle, a slight drop in voltage at the voltage source will not cause a drop in voltage across the cell.

These and other objects and advantages of the present invention will become apparent from the following description when read in connection with the accompanying drawing.

BRIEF DESCRIPTION OF THE DRAWING

The single FIGURE of the drawing is a schematic illustration of an interrupted ignition burner control system constructed in accordance with the present invention.

DESCRIPTION OF THE PREFERRED EMBODIMENT

Referring to the drawing, the system comprises an oil burner 10 having an electric motor 12 operative to supply oil and air to burner 10, an ignition transformer 14 having a primary winding 16 and a secondary winding 18, and a pair of spaced spark electrodes 20 disposed in igniting relationship with burner 10. The burner motor 12 is connected by leads 22 and 24 to terminals 26 and 28 of a conventional 120 volt alternating current power source through a set of normally-closed contacts 29 of a thermally operated safety switch 30 having a bimetal blade 32 and a pivoted latch 34, and a set of normally-open contacts 36 of a relay having a winding 38. The ignition transformer primary winding 16 is connected in series with a controlled solid state ignition switch comprising a triac 40 having main terminals 42 and 44 and a gate terminal 46. The series-connected winding 16 and triac 40 are connected in parallel with burner motor 12.

The secondary winding 48 of a miniature coupling transformer 50 is connected between the gate 46 and main terminal 44 of triac 40. When the primary winding 52 of coupling transformer 50 is sufficiently energized, the induced voltage and accompanying current in the secondary winding 48 cause triac 40 to be gated on, as will be hereinafter described. Because of the inductance of primary winding 16 of ignition transformer 14, a capacitor 54 and a resistor 56 are series connected across main terminals 42 and 44 of triac 40 to provide initial hold-in current for triac 40.

The primary winding 58 of a 120/24 volt step-down transformer 60 is connected across power terminals 26 and 28 through leads 22 and 24 and safety switch 30. The 24 volt secondary winding 62 of transformer 60 has a center tap 64 which divides the secondary winding 62 into an upper portion 66 and a lower portion 68.

Relay winding 38 is connected across the entire secondary winding 62 in series with a space thermostat 70, a resistance heater 72 for heating bimetal blade 32 of safety switch 30, and a flame responsive switch comprising a triac 74 having main terminals 76 and 78 and a gate 80.

Also connected across the entire secondary winding 62, in series with thermostat 70, is a circuit comprising the series connection of a fixed resistor 82, an adjustable resistor 84, a fixed resistor 86, a capacitor 88, and primary winding 52 of coupling transformer 50. A voltage breakdown device comprising a diac 90 is connected between the gate 80 of triac 74 and a junction 92 between capacitor 88 and resistor 86. A photoconductive cell 94, having an extremely high electrical resistance in the absence of light and considerably less resistance when impinged by the light of the burner flame, is connected in parallel with series-connected resistor 86, capacitor 88, and primary winding 52 of transformer 50.

Connected in opposed polarity across series-connected cell 94 and resistor 84, for reasons to be hereinafter described, are two zener diodes 96 and 98, each device having a breakover voltage of approximately 20 volts.

In addition to controlling contacts 36, relay winding 38 also controls another set of normally-open contacts 100 which, when closed, provide a hold-in circuit for relay winding 38 through contacts 100, the lower portion 68 of secondary winding 62, and thermostat 70. The closing of contacts 100 also completes a circuit across upper portion 66 of secondary winding 62 through contacts 100, safety switch resistance heater 72, and triac 74.

OPERATION

Before describing operation of the system under the abnormal condition caused by cell 94 being defective, system operation with a non-defective cell will be described.

Typically, cell 94 has a resistance in excess of 1 megohm in the absence of light and approximately 200 to 300 ohms in the presence of light from the burner flame. Also, resistor 82, functioning as a ballast resistor, is chosen to be approximately 5000 ohms and resistor 84, functioning as a calibrating resistor, is adjusted to be approximately 9000 ohms. Also, diac 90 has a firing voltage of between 6 and 10 volts.

Under normal operating conditions, closing of space thermostat 70 upon a call for burner operation effects the series connection of thermostat 70, resistors 82 and 84, and cell 94 across the entire secondary winding 62 of transformer 60. Because there is no burner flame, cell 94 is of extremely high resistance. Therefore, practically all of the voltage at secondary winding 62 of transformer 60 tends to appear across cell 94 so that zener diodes 96 and 98 break over and provide a 20 volt regulated voltage across the series-connected cell 94 and resistor 84. The difference in voltage between that across secondary winding 62 and zener diodes 96 and 98 is dropped across ballast resistor 82. Practically all of the 20 volt voltage appears across cell 94, enabling capacitor 88 to charge through resistors 82, 84, and 86, and primary winding 52 of transformer 50. Because of the relatively large voltage appearing across capacitor 88 and because of a small RC time constant, capacitor 88 rapidly charges to the firing voltage of diac 90 so that diac 90 becomes conductive.

With diac 90 conducting, capacitor 88 discharges through diac 90 and gate 80 and main terminal 78 of triac 74, turning on triac 74, and through primary winding 52 of coupling transformer 50. When diac 90 conducts, the current flow therethrough includes the discharge current of capacitor 88 and a current flow from secondary winding 62 through resistors 82, 84, and 86. Diac 90 conducts until the current flow therethrough falls below its hold-in value, at which time diac 90 again becomes non-conductive.

The current flow through diac 90 from secondary winding 62 of transformer 60 is preferrably limited by the resistance of resistors 82, 84, and 86 so that it, by itself, is insufficient to provide the hold-in current required to maintain diac 90 conductive. Thus diac 90 becomes non-conductive when the discharge current from capacitor 88 is insufficient to provide the hold-in current. It should be noted, however, that even if the current flow from secondary winding 62 is slightly more than the diac hold-in value, diac 90 is assured of being turned off due to the inherent oscillating between capacitor 88 and primary winding 52 of coupling transformer 50.

With diac 90 again non-conductive, capacitor 88 again charges and fires the diac 90. Since capacitor 88 charges rapidly, as previously described, and discharges rapidly, because of the low impedance of primary winding 52 of coupling transformer 50, diac 90 is turned on and off a number of times, approximately five to ten times, during each half cycle of the alternating current sine wave generated by secondary winding 62 of transformer 60. The resulting increase and decrease of current through the primary winding 52, occurring each time diac 90 is turned on and off, is quite rapid. This causes a plurality of voltage pulses to be induced in the primary winding 52. These pulses induce the same number of pulses in the secondary winding 48 of coupling transformer 50 for a purpose to be hereinafter described.

When triac 74 is gated on, a circuit is completed across the entire secondary winding 62 of transformer 60 through thermostat 70, relay winding 38, safety switch resistance heater 72, and triac 74, causing both sets of normally-open relay contacts 36 and 100 to be closed. Once triac 74 is gated on, it remains on until the current flow therethrough drops below its hold-in value. When that occurs, triac 74 becomes non-conductive until it is again gated on by capacitor 88 and diac 90. Because of the previously described manner of operation of diac 90, triac 74 is cyclically gated on early in each half cycle of the alternating current sine wave being applied thereto. Therefore, triac 74 is on essentially all the time, as long as there is no burner flame.

The closing of relay contacts 100 connects relay winding 38 across the lower portion 68 of secondary winding 62 through thermostat 70 and contacts 100 to provide a hold-in circuit for relay winding 38. This hold-in circuit prevents de-energizing of relay winding 38 when triac 74 is no longer gated on.

The closing of relay contacts 100 also connects safety switch resistance heater 72 and triac 74 across the upper portion 66 of secondary winding 62. Heater 72 begins to heat to provide a timed trial ignition period.

The closing of relay contacts 36 connects the burner motor 12 across the power source terminals 26 and 28 through safety switch 30, relay contacts 36, and leads 22 and 24 to initiate flow of fuel and air to burner 10.

In the manner previously described, a plurality of pulses are induced in the secondary winding 48 of coupling transformer 50. Each of these pulses is of sufficient voltage and generates sufficient current to gate triac 40 on. Therefore, when relay contacts 36 initially close, triac 40 becomes conductive. With triac 40 conductive, ignition transformer 14 is energized and sparking occurs at electrodes 20 to ignite the fuel and air mixture. These conditions persist until either combustion of the fuel and air mixture occurs or until the safety switch 30 opens.

By providing a plurality of gating pulses to triac 40, the effect of a phase difference between a single gating pulse and the sine wave alternating current appearing at triac 40 is negated. A plurality of pulses ensures that a gating pulse will occur early in each half of the sine wave of the current appearing at triac 40 so that triac 40 will conduct during essentially all of the sine wave, as long as gating pulses continue to be generated. This condition ensures sufficient energizing of ignition transformer 14. This condition also ensures sufficient energizing of other igniters, such as electrical resistance igniters, which effect different voltage-current phase angles at triac 40.

Under normal operation, combustion occurs well within the timed trial ignition period. When burner flame appears, the resistance of cell 94 immediately drops sufficiently to shunt capacitor 88 and thus prevent capacitor 88 from charging to the breakdown voltage of diac 90. With diac 90 off, triac 74 is also off so that the safety switch resistance heater 72 is de-energized.

With diac 90 off and capacitor 88 being prevented from charging to the diac firing voltage, pulses no longer appear in primary winding 52 of coupling transformer 50. Thus, when burner flame appears, triac 40 is no longer gated on so that the ignition transformer 14 is de-energized. Since relay winding 38 remains energized, contacts 36 remain closed and burner motor 12 remains energized. Under normal operation, these conditions persist until thermostat 70 opens to de-energize relay winding 38.

If combustion fails to occur, the bimetal blade 32 of safety switch 30 will warp upwardly due to heating of safety switch resistance heater 72 which occurs when triac 74 is conducting, and effect the opening of contacts 29 in safety switch 30. When contacts 29 open, the trial ignition period is terminated and the entire system is de-energized. Latch 34 in safety switch 30 prevents automatic re-closing of contacts 29 as the heater 72 cools, thus requiring a manual unlatching or resetting of the safety switch 30 to enable attempting another burner operation.

As previously stated, it has been observed that cell 94 may become defective due to prolonged exposure to an abnormally high temperature, and no longer possesses the resistance characteristics required for normal system operation. It appears that the failure of cell 94, caused by such exposure, is exhibited by a tendency of the cell resistance to linger at a very low resistance value, when the flame goes out, and to increase very slowly instead of essentially instantaneously. As will now be described, the system of the present invention will ensure safe operation in the event of such a cell failure.

If cell 94 develops the above-described defect during a normal burner cycle, the system will continue to operate normally until thermostat 70 opens to terminate the burner cycle.

If cell 94 is at a very low resistance level on a subsequent call for heat by thermostat 70, most of the voltage at secondary winding 62 of transformer 60 appears across resistors 82 and 84 so that capacitor 88 cannot charge to the firing voltage of diac 90. Under these conditions, triacs 74 and 40 are off, so that no fuel is flowing and no ignition is attempted. If the resistance of cell 94 remains at this very low level, the system will remain in this condition.

If cell 94 increases its resistance sufficiently, its resistance, combined with that of resistor 84, causes zener diodes 96 and 98 to break over sufficiently early in the half-cycles so as to establish a 20 volt voltage level across series-connected cell 94 and resistor 84. As cell 94 further increases its resistance, a larger portion of the regulated 20 volts appears across cell 94 until, finally, the voltage thereacross becomes sufficient to charge capacitor 88 and effect firing of diac 90.

When diac 90 fires, relay winding 38 is energized. Relay winding 38, when energized, comprises an added load on secondary winding 62 of transformer 60, causing the voltage on secondary winding 62 to decrease slightly. Also, the closing of relay contacts 36 effects energizing of burner motor 12, causing a drop in the voltage applied to primary winding 58 of transformer 60 and thus the voltage on secondary winding 62 thereof. Depending on the size of motor 12 and the length and size of leads 22 and 24, this drop in voltage can be significant. However, because zener diodes 96 and 98 are well within their 20 volt regulating voltage level, a drop in voltage on secondary winding 62, due to the above described factors, will not cause zener diodes 96 and 98 to cease their regulating function. Thus, the voltage across cell 94 remains sufficient to effect charging of capacitor 88 to the firing voltage of diac 90, and diac 90 will continue to turn on and off as required for normal operation.

If combustion occurs and the resistance of cell 94 does not decrease rapidly enough in response to light from the burner flame, cell 94 will effect continued gating of triac 74, and thus continued energizing of safety switch resistance heater 72, until contacts 29 in safety switch 30 open to terminate the burner cycle. If the resistance of cell 94 does decrease rapidly enough, cell 94 will effect non-conduction of triac 74 before heater 72 is heated sufficiently to open safety switch contacts 29, and the burner cycle will continue until thermostat 70 opens.

If combustion does not occur, the resistance of cell 94 continues to increase. Under this condition, triac 74 continues to be gated on until safety switch contacts 29 open to de-energize the system.

It is noted that, without zener diodes 96 and 98, the above-described drop in voltage at secondary winding 62 would cause a corresponding drop in voltage across cell 94 so that capacitor 88 could no longer charge to the firing voltage of diac 90. Diac 90 would, therefore, shut off. Diac 90 would subsequently be gated on again only when the resistance of cell 94 increased to a higher level than originally required, the higher level being a result of the reduced voltage available at secondary winding 62. During the indeterminate time period between the first turn-on of diac 90 and a subsequent one, relay winding 38 would be held in by its contacts 100 so that contacts 100 and 36 would remain closed. With contacts 36 closed, burner motor 12 would be energized to supply fuel and air to burner 10. However, with triac 74 off, heater 72 is de-energized and triac 40 is off. This condition, wherein fuel is flowing but ignition transformer 14 and safety switch resistance heater 72 are de-energized, would be unacceptable as it would result in an accumulation of unburned fuel in the combustion chamber.

While a preferred embodiment of the present invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

I claim:

1. In an electrically operated control system for controlling operation of a fuel burner and an ignition device, a triac;

gating circuit means for causing said triac to be conductive in the absence of a burner flame and non-conductive in the presence thereof;

a relay having a winding connected in series with said triac and effective, when energized, for connecting the fuel burner across a power source to initiate flow of fuel;

circuit means, effective when said gating circuit means is operative to effect conduction of said triac, for energizing the ignition device;

circuit means for establishing a timed trial ignition period including a safety switch resistance heater connected in series with said triac;

hold-in circuit means, independent of said triac, for maintaining said relay winding energizing as long as there is a call for heat;

said gating circuit means including a photoconductive cell normally having high electrical resistance in said absence of a burner flame and low electrical resistance in said presence of a burner flame, a capacitor connected in parallel with said cell so as to charge when said cell exhibits said high electrical resistance, a voltage breakdown device connected in circuit with said capacitor and said triac and rendered conductive, when said capacitor attains a sufficient charge, so as to cause said triac to become conductive, and regulating circuit means connected in circuit with said cell and effective, in the event that said cell abnormally exhibits said low electrical resistance in said absence of a burner flame and is increasing in resistance, for maintaining an adequate voltage across said cell to effect continued conduction of said triac, once said triac becomes conductive, until the resistance of said cell decreases sufficiently in response to said presence of a burner flame to effect non-conduction of said triac, or until said heater is heated sufficiently to effect termination of said timed trial ignition period;

said regulating circuit means providing the sole means for ensuring said continued conduction of said triac and comprising a first resistor connected in series with said cell, two zener diodes connected in series with each other and in opposed polarity, said series-connected zener diodes being connected in parallel with said series-connected cell and first resistor, and a second resistor connected in series with both said series-connected zener diodes and said series-connected cell and first resistor.

* * * * *